US005156330A

United States Patent [19]

Rosen

[11] Patent Number: 5,156,330

[45] Date of Patent: Oct. 20, 1992

[54] PACKAGING CONTAINER PROVIDED WITH AN INDICATION FOR OPENING

[75] Inventor: Ake Rosen, Helsingborg, Sweden

[73] Assignee: Tetra Alfa Holdings S.A., Pully, Switzerland

[21] Appl. No.: 834,353

[22] Filed: Feb. 12, 1992

[30] Foreign Application Priority Data

Feb. 14, 1991 [SE] Sweden ..... 9100438

[51] Int. Cl.[5] ..... B65D 5/54

[52] U.S. Cl. ..... 229/216; 229/3.5 R; 229/242

[58] Field of Search ..... 229/213, 214, 216, 217, 229/219, 237, 240, 242, 3.5 R

[56] References Cited

U.S. PATENT DOCUMENTS

| | | | |
|---|---|---|---|
| 3,577,484 | 5/1971 | Jacobson | 229/237 |
| 3,797,726 | 3/1974 | Reil | 229/216 |
| 4,301,927 | 11/1981 | Carlsson et al. . | |
| 4,343,402 | 8/1982 | Holmström . | |
| 4,445,309 | 5/1984 | Reil . | |
| 4,464,156 | 8/1984 | Holmström . | |
| 4,691,858 | 9/1987 | Peer, Jr. | 229/217 |
| 4,703,876 | 11/1987 | Reil | 229/216 |
| 4,740,163 | 4/1988 | Kuchenbecker | 229/214 |
| 4,811,849 | 3/1989 | Rausing . | |
| 4,865,203 | 9/1989 | Ueda | 229/237 |
| 4,915,236 | 4/1990 | Kamin et al. | 229/216 |

FOREIGN PATENT DOCUMENTS

| | | |
|---|---|---|
| 0353496 | 2/1990 | European Pat. Off. . |
| 0353991 | 2/1990 | European Pat. Off. . |
| 2939093 | 4/1981 | Fed. Rep. of Germany . |
| 59227 | 3/1981 | Finland . |
| 344725 | 5/1972 | Sweden . |
| 418950 | 7/1981 | Sweden . |

*Primary Examiner*—Gary E. Elkins

*Attorney, Agent, or Firm*—Burns, Doane, Swecker & Mathis

[57] ABSTRACT

Packaging container of a material containing a skeletal layer of plastic and filler mixed into the plastic in a quality of between 50 and 80% of the total weight of the skeletal layer. In order to facilitate the opening of the container the container is provided with a tearing mark incorporated in the packaging material, along which the material in the container must be torn to expose a container opening through which the contents of the container are made accessible. The tearing mark consists of an unbroken recess in the skeletal layer or a similar linear recess weakening the material with a depth of penetration of approximately 10-30% of the total thickness of the skeletal layer.

14 Claims, 1 Drawing Sheet

PACKAGING CONTAINER PROVIDED WITH AN INDICATION FOR OPENING

FIELD OF THE INVENTION

The present invention concerns a packaging container of the type having an integral part forming a pouring spout and, more particularly, to a packaging container having a pouring spout with an opening that can be easily torn open.

BACKGROUND OF THE INVENTION

Packaging material is manufactured through fold forming, thermo-forming or other mechanical treatment for shaping of a strip or a prefabricated substance of flexible packaging material. For the purpose of making the packaging container easy to open, a tearing mark is incorporated in the container wall, the tearing of which entails that a part of the wall delimited by the tearing mark can be pulled up or torn off completely to expose a corresponding opening through which the packaging container can be emptied of its contents.

Within packaging technology finished consumer packagings of disposable character have long been used which are made of a laminated, flexible packaging material containing one or more skeletal layers of paper or cardboard and outer layers of plastic, usually polythene. These so-called disposable packagings are now most frequently produced with the aid of rational, modern packaging machines of the kind that both shapes, fills and closes the packagings on a large industrial scale.

From, for example, a strip of the packaging material of such a disposable packaging is produced through the strip first being shaped into a tube through the two longitudinal edges of the strip being joined to each other in a longitudinal overlap joint. The tube is filled with the contents and divided up into closed, filled packaging units through repeated transverse sealings of the tube across the longitudinal direction of the tube below the level of contents of the tube. The cushion-shaped packaging units are separated from each other through cuts in the transverse sealing zones and are given the desired, usually parallelepiped shaped final form through a final shaping and sealing operation during which the two upper triangular, double-walled corner flaps are folded down against and sealed to adjacent, opposite sides of the packaging and the two lower triangular, double-walled corner flaps are bent inwards towards and sealed to the bottom end of the packaging. A well known example of such a parallelepiped shaped disposable packaging is Tetra Brik (reg. trade mark) which is used for packaging and transporting among other things liquid foodstuffs such as milk, juice, wine etc.

Another well known example of a disposable packaging of the type described above is Tetra Top (reg. trade mark) which is also used for packaging and transporting among other things liquid foodstuffs such as milk, juice etc. This known disposable packaging is manufactured from a prefabricated substance of a paper or cardboard based packaging material through the substance first being shaped into a tube through the two opposite sides of the substance being joined to each other in a longitudinal overlap joint. One open end of the tube (corresponding to the top part of the packaging) is closed with the aid of a plastic lid which is injection moulded in place at the end of the tube. The tube is then filled with desired contents and is closed through fold forming of the end parts of the tube to form a bottom closure of the same type as in the above described type of packaging.

The requirement set for disposable packagings and packagings in general is of course that they must give the best possible mechanical and chemical protection to the product that is to be packaged, but also that they must be easy to open without implements, e.g. scissors, and that the contents of the packaging must be able to be poured out in a collected and well directed stream through the opening in the packaging.

In order to fulfill the requirement for good opening and pouring properties the known packagings are most frequently provided with some type of opening device, e.g. a tearing mark incorporated in the packaging wall as described in Swedish patent 344 725. This opening device which preferably appears on disposable packagings of the type Tetra Brik can, as described in Swedish patent 344 725, consist of a perforated tearing mark applied to one upper corner flap of the packaging, extending around the whole corner flap in an area between the tip and the base line of the corner flap (corresponding to one side of the top of the packaging). The packaging is opened through the corner flap being pulled away and bent upwards from its downward facing sealing position against the adjacent side of the packaging, after which the part of the flap situated outside the perforated tearing mark is gripped and torn off completely through the breaking of the perforated tearing mark which goes around it, so as to expose a pipe-shaped opening through which the packaging can be emptied of its contents.

An opening device of this kind is simple and easily manufactured and does not require any complicated separate equipment for its manufacture, but often produces an uneven, frayed tearing edge around the contour of the opening which impairs the desired collected and well directed stream. The problem is further aggravated by exposure of the fibrous material in the skeletal layer all around the contour of the opening to liquid. The material easily absorbs liquid and after a relatively short time the pipe-shaped flap opening becomes floppy and difficult to handle, sometimes stopping flow as a result.

Disposable packagings of the kind described above can, however, also be manufactured from other known packaging material which is completely free of paper and cardboarded layers or other layers of water-absorbent material. For example EP-A-O 353 991 and EP-A-O 353 496 describe a packaging material free of absorbent fibrous layers which is sufficiently flexible to let itself be shaped, through fold forming, into, for example, a packaging material of the Tetra Brik type. This known packaging material includes a stiffening skeletal layer of plastic and filler mixed into the plastic to an amount of between 50 and 80% of the total weight of the skeletal layer. The plastic in the skeletal layer is preferably a polyolefin plastic such as polythene, polypropylene etc. Preferably a polypropylene based plastic is used such as a propylene homopolymer with a melting index of under 10 according to ASTM (2.16 kg; 230° C.) or an ethylene/propylene copolymer with a melting index of between 0.5 and 5 according to ASTM (2.16 kg; 230° C.). Neither EP-A-O 353 991 nor EP-A-O 353 496, however, gives a single example of how a packaging of the described packaging material should be shaped to be easily opened and to be able to be emptied of its contents in the desired collected and well directed stream.

OBJECTS AND SUMMARY OF THE INVENTION

An aim of the present invention is therefore to describe an easily opened packaging container of the type described above that avoids problems of the kind that exist in the known packaging containers.

Another aim is to provide a packaging container with both good opening and pouring qualities without the use of a waterabsorbent paper or cardboard based packaging material.

These and other aims and advantages are achieved according to the invention in a packaging container that is manufactured from a packaging material containing a skeletal layer of plastic and filler mixed into the plastic to an amount of between 50 and 80% of the total weight of the skeletal layer. The tearing mark constitutes an unbroken cut or similar linear recess in the skeletal layer which weakens the material.

In accordance with the present invention it has thus proved possible to combine in one and the same packaging container the advantages of the opening device described by Swedish patent 344 725 with the advantages offered by the known packaging material according to EP-A-O 353 991 and EP-A-O 353 496 in such a way that the packaging material is both easily worked and easily opened. In particular it has been shown that the edge of the tear resulting after the tearing along the tearing mark around the whole contour of the opening on the opened packaging container according to the invention is very even and practically completely free of tear fringes or tear tufts which interfere with emptying the carton. Even where the inherent tear resistance of the packaging material is certainly relatively high, the tearing resistance can be made very low if the material is provided with a tearing mark and the tear is made along the tearing mark. It has been shown quite surprisingly that the tearing can comfortably be done with the use of considerably less tearing force than that required in the tearing of a corresponding paper material with a perforated tearing mark, even if the depth of penetration of the tearing mark only amounts to 10–30% of the total thickness of the skeletal layer.

In order to facilitate further the detachment or tearing off of the openable part of the wall, the packaging container according to the invention can be provided with an easily accessible gripping device such as a gripping ring or a gripping flap connected with the part of the wall, which can be an integral part of the wall or consist of the entire detachable or tear-off part of the wall.

In a packaging container of the above described Tetra Brik type the tearing mark can preferably be located around one of the upper traingular corner flaps of the container in an area between the base line of the corner flap (corresponding to one side of the top of the packaging) and the tip of the corner flap, whereby the tear-off part of the wall which forms the opening thus consists of the whole part of the flap situated outside the tearing mark in the direction of the tip of the corner flap, which at the same time serves as a gripping device facilitating the tearing off.

DESCRIPTION OF THE DRAWINGS

The invention will be described in greater detail below with particular reference to the enclosed drawings in which.

DETAILED DESCRIPTION

Figure 1:
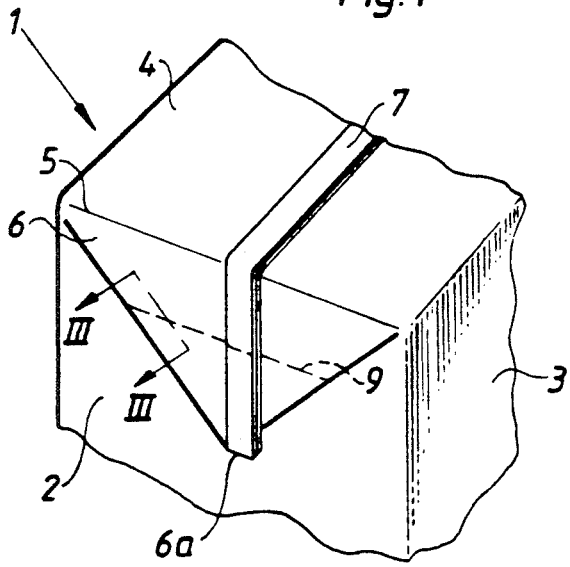
FIG. 1 is a perspective view of an upper corner flap of a packaging container of conventional type which is provided with an opening device according to the invention.
Figure 2:
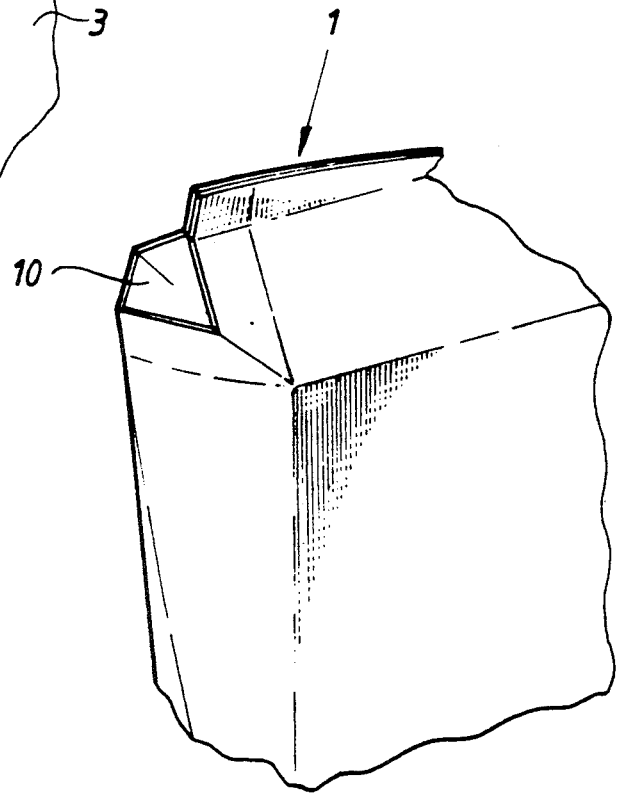
FIG. 2 is a corresponding perspective view of the packaging container in FIG. 1 after opening.

The packaging container according to the invention, of which only an upper corner section is shown, has been given the general reference designation 1 in FIGS. 1 and 2. The packaging container 1 is of the known Tetra Brik type which has a prismatic geometric outer form comprising four side walls opposite each other in pairs 2 and 3 respectively and a mainly flat topside 4 which on two opposite sides 5 (of which only one is shown) exhibit double-walled triangular corner flaps 6 which are each connected with and form a transition between the topside 4 and the respective adjacent side wall 2. The packaging container 1 has in addition a sealing fin 7, extending from the tip 6*a* of one corner flap 6 to the tip of the other corner flap (not shown) transversely across the topside 4, in which facing edge parts of the packaging material are joined to each other inside to inside in a sealing seam closing the topside 4 and the corner flap 6 respectively. The two upper corner flaps 6 of the packaging container with the corresponding end sections of the sealing fin 7 are bent downwards towards and sealed to the respective adjacent side walls 2 in order not to be in the way and to be protected in handling during transport etc.

A packaging container of the known type shown in FIGS. 1 and 2 is conventionally manufactured from a strip of a flexible packaging material through the strip first being shaped into a tube through the two longitudinal edges of the strip being joined to each other in a longitudinal overlap joint. The tube is filled with the contents in question and divided into closed packaging units through repeated transverse sealings of the tube across the axis of the tube below the level of contents of the tube. The cushion shaped packaging units are separated from each other through cuts in the tube's transverse sealing zones and are given the desired parallelepiped shaped final form through a final shaping and sealing operation during which the two upper triangular, double-walled corner flaps of the packaging are bent downwards towards and sealed to an adjacent side of the packaging, as shown in FIG. 1.

Figure 3:
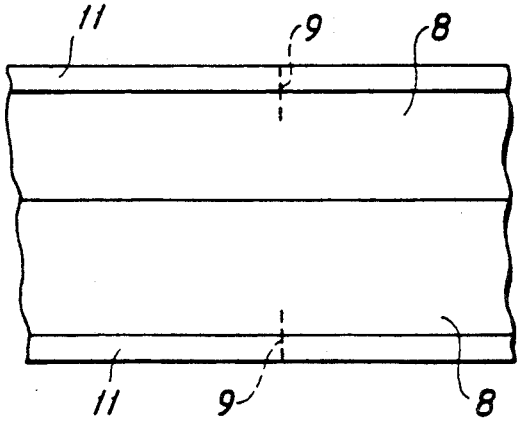
FIG. 3 is an enlarged section along the line III—III in FIG. 1.

The packaging container 1 according to the invention is manufactured from a flexible packaging material of the type which is described in the two previously mentioned European patent applications EP-A-O 353 991 and EP-A-O 353 496 and which is shown in double-weight form in the section along the line III—III in FIG. 3.

The packaging material thus comprises a stiffening skeletal layer 8 of plastic and a filler mixed into the plastic to an amount of between 50 and 80% of the total weight of the skeletal layer. The plastic in the skeletal layer 8 is preferably a polyolefin plastic such as polythene, polypropylene etc., of which a polypropylene based plastic is the most preferred plastic in the skeletal layer. Examples of such polypropylene based plastics include a propylene homopolymer with a melting index of under 10 according to ASTM (2.16 kg; 230° C.) and an ethylene/propylene copolymer with a melting index of between 0.5 and 5 according to ASTM (2.16 kg; 230° C.). Of these two aforementioned polypropylene based plastics the ethylene/propylene copolymer is the most preferred, since it retains its good sealing and mechanical resistance properties also at low temperatures, e.g. 8° C. or lower. The filler in the skeletal layer 8 can be any known granular and/or flaked filler in the field such as chalk, mica, talc, clay etc, preferably chalk. The amount of filler varies between 50 and 80% of the total weight of the skeletal layer, but is preferably approximately 65% of the weight.

The thickness of the skeletal layer can vary depending on whether the packaging material is to be fold formed, thermoformed or mechanically processed for shaping in another manner, but is generally situated within the thickness range 150–1400 μm. If a substance or a strip of the packaging material is to be shaped into packagings through fold forming, the skeletal layer 8 has preferably a thickness in the lower part of the thickness range, e.g. 150–300 μm, while the skeletal layer 8 has preferably a thickness in the upper part of the thickness range, e.g. 1000–1400 μm if the packaging is to be used for the manufacture of packagings through thermo-forming or other mechanical processing for shaping. When the packaging material is used for manufacture of packaging containers of the type which is shown in FIGS. 1 and 2 or other conventional packaging types for transporting liquid foodstuffs such as milk, juice, wine etc., the skeletal layer 8 can have a thickness of approximately 400 μm, which makes the packaging material sufficiently flexible to be easily able to be shaped by fold forming and which at the same time gives the desired stability of form to the packaging produced.

When the packaging container 1 in FIG. 1 is to be opened and emptied of its contents the corner flap 6 is pulled away from its bent-down sealing position and bent outwards and upwards to the opening position shown in FIG. 2, after which the corner flap is torn off along a tearing mark 9 shown with a dotted line in FIG. 1, which extends around the whole corner flap 6 between the base line 5 of the corner flap and the tip 6*a* of the corner flap to expose a pipe shaped opening 10 (FIG. 2) through which the container's contents are made accessible.

The tearing mark 9 according to the invention can consist of an unbroken cut or similar linear recess which weakens the material in the skeletal layer 8, preferably a cut incised in one side of the skeletal layer (corresponding to the outside of the container) as shown in FIG. 3. It is self-evident that the intended weakening of the material increases with increasing depth of penetration in the cut 9 and that consequently the tear resistance of the packaging material decreases with increasing depth of penetration. However, according to the invention it has surprisingly been shown that a sufficient weakening of the material and therewith sufficiently low tear resistance in the packaging material is already achieved with a very small depth of penetration which only amounts to a few percent of the total thickness of the skeletal layer, irrespective of whether the thickness of the skeletal layer is situated within a lower or upper part of the abovementioned thickness range, 150–1400 μm. Defined in greater detail it has been shown that a tearing mark 9 with a depth of penetration corresponding to only 10–30% of the total thickness of the skeletal layer 8 gives a 60–80% reduction of the inherent tear resistance of the skeletal layer and thereby a sufficiently good weakening of the material for the packaging material in a packaging container manufactured from the material to be easily able to be opened by tearing along the tearing mark in the way described above. With a skeletal layer thickness of approximately 400 μm it is thus sufficient with a depth of penetration of approximately 30 μm. Besides the fact that the packaging material is easily torn with the aid of such a tearing mark, the edge of the tear around the whole contour of the opening around the emptying opening 10 is in addition straight and very even, without projecting tear fringes or tear tufts which interfere with emptying as is the case after the tearing of conventional paper or cardboard based packaging material. Since the packaging material in the packaging container according to the invention is entirely without liquid-absorbent fibrous layers there is also no risk of the exposed tear edge coming to have a negative effect owing to absorption of liquid by the container on contact with the contents of the container during pouring out.

In order to facilitate further the tearing off of the part of the wall forming the opening and delimited by the tearing mark the packaging container 1 can be provided with an easily accessible gripping device with the aid of which the part of the wall can easily be torn off. Such a gripping device can, for example, consist of an integral part of the tear-off part of the wall, e.g. a corner flap section, or may consist of a separate pull tab or pull ring attached to the part of the wall. In the example shown in FIG. 1 the whole corner flap section outside the tearing mark 9 serves as the aforesaid gripping device.

As shown in FIG. 3 the packaging material in the packaging container in FIG. 1 can also have an outer sealing and/or protective layer 10 joined to one side of the skeletal layer 8 to improve the sealing properties of the packaging material and/or give protection to the underlying skeletal layer 8 if so desired. The outer layer 10 can have a thickness of approximately 5–50 μm and consists preferably of plastic of the same type as the plastic in the skeletal layer 8. The advantage of using the same plastic in the skeletal layer 8 and the outer layer 10 is that the packaging material thereby becomes what is known as a homogeneous material which is both easy to recuperate and reuse and thus has the effect that the production of the packaging material can be effected with the least possible wastage of material. The packaging material in addition becomes a very advantageous material from the environmental standpoint.

While the invention has been described with reference to a specially preferred and particularly outstanding embodiment it is obvious to one skilled in the art to which the present invention pertains that within the framework of the concept of the invention it is also possible to put the invention into practice through minor, close modifications of the detailed embodiment described as an example. For example, the tearing mark need not consist of an incised cut, but can be a recess in the skeletal layer achieved through compression of the material or plastic deformation, and furthermore the tearing mark can be located at any desired place on the packaging material other than around one of the corner flaps of the packaging as shown. Thus the tearing mark can consist of two parallel cuts extending round the whole packaging container between the top and the bottom of the packaging container, with the tear-off part of the wall in that case consisting of the part of the wall of the packaging situated between the cuts. According to the invention, the tearing mark need not delimit either a closed part of the wall which is intended to be torn off completely. The tearing mark can be a U-shaped cut on, for example, the top of the packaging, with the part of the wall forming the opening in that case consisting of the part of the top of the packaging situated within the U-shaped cut which, on the opening of the packaging, is intended to be detached without being wholly removed.

While this invention has been illustrated and described in accordance with a preferred embodiment, it is recognized that variations and changes may be made therein without departing from the invention as set forth in the claims.

What is claimed is:

1. A packaging container of the type which is produced by mechanical treatment for shaping of a strip of flexible packaging material and which for the purpose of making the packaging material easy to open has a tearing mark located in the wall of the container, the tearing of which entails that a part of the wall delimited by the tearing mark can be detached or torn off completely to expose a corresponding opening through which the packaging container can be emptied of its contents, comprising packaging material having a skeletal layer of plastic and filler mixed into the plastic to an amount of between 50 and 80% of the total weight of the skeletal layer, and tearing means in the skeletal layer which weakens the material, the tearing means defining a tearable part of the packaging material that is intended to be torn off.

2. The packaging container according to claim 1, wherein the tearing means includes a recess having a depth of penetration of only 10–30% of the total thickness of the skeletal layer.

3. The packaging container according to claim 1 further comprising gripping means for facilitating the tearing off of the part of the packaging material.

4. The packaging container according to claim 1, wherein the tearing means is formed through local compression of the packaging material.

5. The packaging container according to claim 1 wherein the plastic in the skeletal layer is a polyolefin.

6. The packaging container according to claim 5, wherein the polyolefin is a polypropylene based plastic with a melting index of under 10 according to ASTM standard test (2.16 kg; 230° C.).

7. The packaging container according to claim 5, wherein the polyolefin is a propylene homopolymer with an ASTM standard test melting index of under 10.

8. The packaging container according to claim 1, wherein the filler in the skeletal layer is selected from the group consisting of chalk, mica, talc, and clay.

9. The packaging container according to claim 1 wherein the skeletal layer has, on at least one side, a sealing layer, attached to the skeletal layer, of plastic of the same type as the plastic in the skeletal layer.

10. The packaging container according to claim 9, wherein the sealing layer has a thickness of between 5 and 50 μm.

11. A packaging container according to claim 3, wherein the gripping means includes a gripping tab.

12. A packaging container according to claim 3, wherein the gripping means includes a gripping ring.

13. A packaging container according to claim 3, further comprising a grippable corner flap, the gripping means comprising the corner flap.

14. A packaging container according to claim 5, wherein the polyolefin is an ethylene/propylene copolymer with an ASTM standard test melting index of between 0.5 and 5.

* * * * *